US009828959B2

(12) United States Patent
Teike et al.

(10) Patent No.: US 9,828,959 B2
(45) Date of Patent: Nov. 28, 2017

(54) HIGH-PRESSURE FUEL PUMP HAVING AN OUTLET VALVE

(71) Applicant: Robert Bosch GmbH, Stuttgart (DE)

(72) Inventors: Gerd Teike, Ditzingen (DE); Michael Kleindl, Schwieberdingen (DE); Soeren Stritzel, Boeblingen (DE)

(73) Assignee: Robert Bosch GmbH, Stuttgart (DE)

( * ) Notice: Subject to any disclaimer, the term of this patent is extended or adjusted under 35 U.S.C. 154(b) by 4 days.

(21) Appl. No.: 14/909,730

(22) PCT Filed: Jun. 18, 2014

(86) PCT No.: PCT/EP2014/062806
§ 371 (c)(1),
(2) Date: Feb. 2, 2016

(87) PCT Pub. No.: WO2015/014536
PCT Pub. Date: Feb. 5, 2015

(65) Prior Publication Data

US 2016/0169174 A1 Jun. 16, 2016

(30) Foreign Application Priority Data

Aug. 2, 2013 (DE) ..... 10 2013 215 275

(51) Int. Cl.
*F02M 59/46* (2006.01)
*F02M 63/00* (2006.01)

(52) U.S. Cl.
CPC ..... *F02M 59/462* (2013.01); *F02M 63/0054* (2013.01); *F02M 2200/50* (2013.01)

(58) Field of Classification Search
CPC ..... F02M 59/462; F02M 63/0054; F02M 2200/50
See application file for complete search history.

(56) References Cited

U.S. PATENT DOCUMENTS 3,894,556 A * 7/1975 Pareja ..... F16K 15/044 137/539
4,365,648 A * 12/1982 Grothe ..... F16K 15/044 137/539

(Continued)

FOREIGN PATENT DOCUMENTS

EP 0 976 925 A2 2/2000
FR 2 775 326 A1 8/1999

OTHER PUBLICATIONS

International Search Report corresponding to PCT Application No. PCT/EP2014/062806, dated Sep. 23, 2014 (German and English language document) (5 pages).

*Primary Examiner* — Jessica Cahill
*Assistant Examiner* — Frederick D Soski
(74) *Attorney, Agent, or Firm* — Maginot, Moore & Beck LLP

(57) ABSTRACT

A high-pressure fuel pump includes an outlet valve, a valve ball, a valve spring that acts on the valve ball in a closing direction, and a stop body for the valve ball. The stop body has a stop section that limits the opening stroke of the valve ball, and the valve spring is supported by the stop body. The stop body has a cut-out section that at least partially accommodates the valve spring and that has a radial inner periphery which forms a guide for the valve spring.

9 Claims, 3 Drawing Sheets

(56) References Cited

U.S. PATENT DOCUMENTS

| | | | | |
|---|---|---|---|---|
| 5,609,182 | A * | 3/1997 | Beck | B23P 11/00 137/539 |
| 5,967,180 | A * | 10/1999 | Yates, III | F16K 15/044 137/533.13 |
| 6,550,698 | B2 * | 4/2003 | Ness | F16K 21/08 239/132 |
| 6,910,494 | B2 * | 6/2005 | Warsakis | F16B 4/004 137/15.18 |
| 7,708,026 | B2 * | 5/2010 | Neto | F01M 1/08 123/41.35 |
| 2002/0036014 | A1 * | 3/2002 | De Matthaeis | F02M 59/462 137/539 |
| 2008/0292473 | A1 | 11/2008 | Marino et al. | |
| 2010/0242922 | A1 * | 9/2010 | Mancini | F02M 59/462 123/506 |
| 2013/0333770 | A1 * | 12/2013 | Maita | F02M 59/48 137/315.41 |
| 2014/0311597 | A1 * | 10/2014 | Mooney | F02M 63/0054 137/539.5 |
| 2015/0040868 | A1 * | 2/2015 | Graham | F02M 63/0054 123/456 |

* cited by examiner

HIGH-PRESSURE FUEL PUMP HAVING AN OUTLET VALVE

This application is a 35 U.S.C. §371 National Stage Application of PCT/EP2014/062806, filed on Jun. 18, 2014, which claims the benefit of priority to Serial No. DE 10 2013 215 275.2, filed on Aug. 2, 2013 in Germany, the disclosures of which are incorporated herein by reference in their entirety.

BACKGROUND

The disclosure concerns a high-pressure fuel pump.

High-pressure fuel pumps, in particular piston pumps for a fuel system for an internal combustion engine, are known from the market. Frequently, such high-pressure fuel pumps comprise an inlet valve and an outlet valve which can open and close depending on a control command and/or depending on a fuel pressure. The outlet valve allows a pressurized fuel accumulator (rail) to close against a delivery chamber of the high-pressure fuel pump during a suction stroke. When however the fuel pressure in the delivery chamber exceeds a counter-force caused by the pressure in the fuel accumulator plus a closing spring force, the outlet valve can open.

SUMMARY

The problem on which the disclosure is based is solved by a high-pressure fuel pump as described herein. Advantageous refinements are given in the subclaims. Features important to the disclosure are also contained in the description which follows and in the drawings, wherein the features may be important for the disclosure both alone and in different combinations, without this being explicitly mentioned.

The disclosure concerns a high-pressure fuel pump having an outlet valve, a valve ball, a valve spring acting on the valve ball in the closing direction, and a stop body for the valve ball with a stop portion which limits the opening stroke of the valve ball, wherein the valve spring rests on the stop body. The stop body has a recess in which the valve spring is received at least in regions, and the radially inner limiting surface of which forms a guide for the valve spring. By means of the recess, the valve spring can be guided comparatively precisely, whereby the outlet valve can be constructed smaller. Thus the high-pressure fuel pump can be made particularly versatile in design. The disclosure has the advantage that an outlet valve of a high-pressure fuel pump has a comparatively low hydraulic adhesion of a valve element to a sealing seat, since this can be formed linear. Accordingly, the noise during an opening process of the outlet valve can be reduced.

In one embodiment of the high-pressure fuel pump, an edge of the recess facing the valve ball in the stop body forms an annular stop portion. This allows a defined limitation for the opening travel (stroke) of the valve element, whereby the function of the outlet valve can be improved. In particular, as a result of the stroke limitation, a closing time of the outlet valve can be kept comparatively short and relatively constant. This allows a reduction in so-called "back flow losses" during an incipient suction phase of the high-pressure fuel pump, wherein a fuel already compressed to high pressure can flow back from the high-pressure accumulator (rail) to the delivery chamber of the high-pressure fuel pump. A delivery level of the high-pressure fuel pump can thus be increased. Preferably, the stop portion is designed at least approximately conical. In this way, the valve ball can be held definedly in an opened state of the outlet valve.

The outlet valve becomes cheaper if the valve ball comprises a comparatively economic steel material. A comparatively costly valve ball made of a ceramic material is therefore not necessary for the outlet valve according to the disclosure.

In a further embodiment of the high-pressure fuel pump, the recess has a simple cylindrical cross-section. In this way, production of the outlet valve can be simplified and made cheaper. In a further embodiment of the high-pressure fuel pump, the valve spring is configured as a pressure-loaded coil spring and has different diameters in an axial direction, and in particular is waisted. In this way, the construction space of the valve spring or coil spring can be reduced and the function of the outlet valve improved, in particular a non-linear spring characteristic can be achieved.

In a preferred embodiment, the outlet valve of the high-pressure fuel pump has a valve body on which a sealing seat is formed and which has a guide collar in which the valve ball is guided radially, wherein the guide collar has a first plurality of recesses which are arranged distributed—preferably evenly—in the peripheral direction and form first flow channels, and wherein the stop body, radially outside the recess, has a second plurality of recesses which are arranged distributed —preferably evenly—in the peripheral direction and form second flow channels, wherein the cross-section areas of the second flow channels are selected such that, independently of the radial orientation of the stop body, at least one second flow channel at least partly overlaps with a first flow channel. This describes a particularly suitable embodiment of the high-pressure fuel pump according to the disclosure. In particular, the mounting of the valve body, valve ball, coil spring and stop body may be particularly simple. In this way, production of the high-pressure fuel pump may be made cheaper. Elements of the outlet valve may be mounted independently of a radial angle of the elements to each other, and installation is therefore simplified.

In addition, it may be provided that the first plurality and the second plurality are different. In this way, above all with an even distribution of recesses, effectively a radial "interference" is created between the first and second flow channels, whereby a total resulting hydraulic opening cross-section is substantially independent of a radial angle between the guide collar and the stop body. This improves the function of the outlet valve and simplifies the installation, since the elements need not be aligned in the peripheral direction.

In a further embodiment it is proposed that the stop body is formed as a punched part and/or deep-drawn part. In this way, the outlet valve and hence the high-pressure fuel pump according to the disclosure become cheaper.

In a further embodiment, the stop body and/or the valve body are arranged by force fit—in particular by pressing—in a housing of the outlet valve. In this way, installation of the outlet valve becomes simpler and its production therefore cheaper.

BRIEF DESCRIPTION OF THE DRAWINGS

Exemplary embodiments of the disclosure are described in more detail with reference to the drawings. The drawings show.

DETAILED DESCRIPTION

Figure 1:
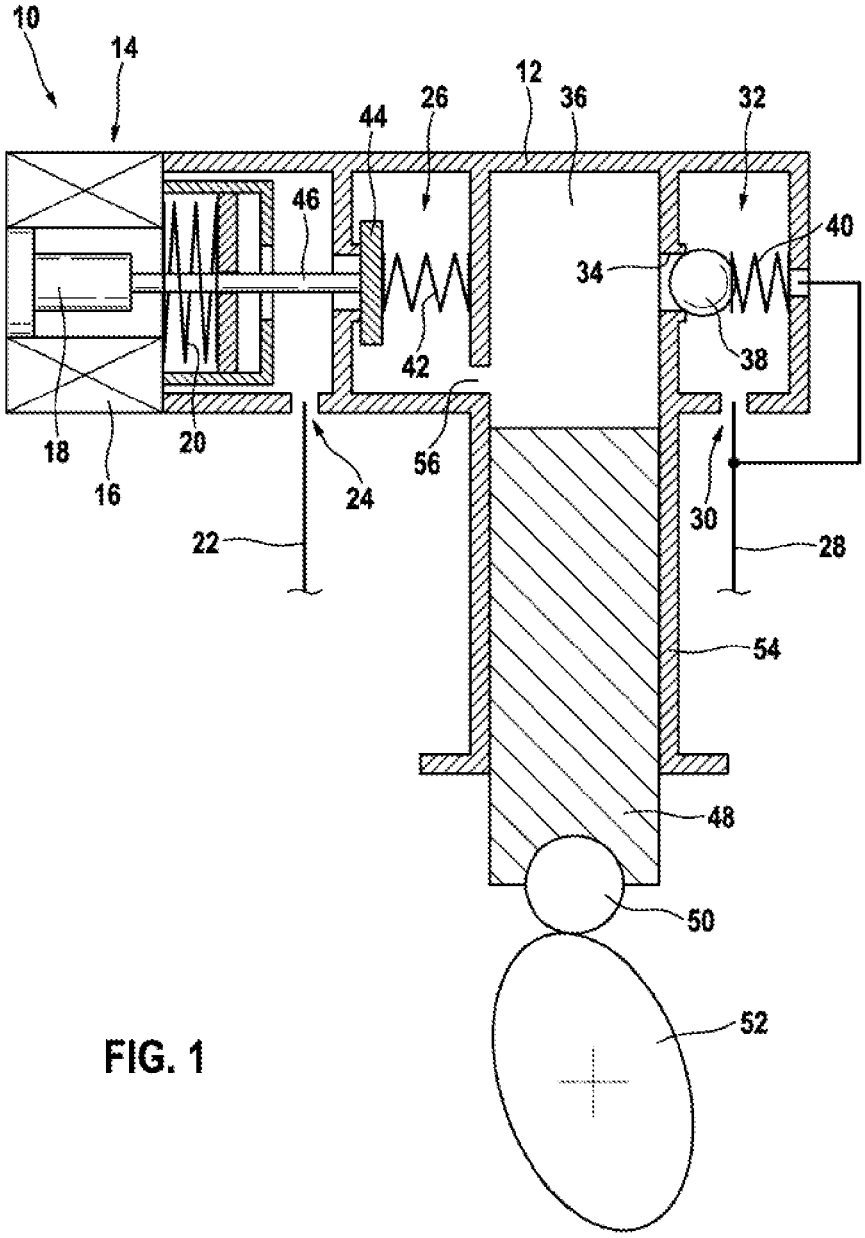
FIG. 1 a diagram of a high-pressure fuel pump of a fuel system for an internal combustion engine of a motor vehicle in a simplified axial section view.

Values and elements of equivalent function, even in different embodiments, carry the same reference numerals in all figures.

FIG. 1 shows a simplified diagram of a high-pressure fuel pump 10 in an axial section view. The high-pressure fuel pump 10 is an element of a fuel system (not shown) of an internal combustion engine (not shown) of a motor vehicle. The high-pressure fuel pump 10 has a housing 12, in the portion of which on the left in the drawing are arranged an electromagnet 14 with a magnetic coil 16, an armature 18 and an armature spring 20.

Furthermore, the high-pressure fuel pump 10 comprises an inlet 24 with an inlet valve 26 connected to a low-pressure line 22, and an outlet 30 with an outlet valve 32 connected to a high-pressure line 28. A high-pressure accumulator (rail) connected to the high-pressure line 28 is not shown. In open state, the outlet valve 32 is hydraulically connected to a delivery chamber 36 via an opening 34. The outlet valve 32 comprises a valve ball 38 and a valve spring 40, and is depicted only highly diagrammatically in FIG. 1. The outlet valve 32 is shown again and described in detail further below with reference to FIGS. 2 and 3.

The inlet valve 26 comprises a valve spring 42 and a valve body 44. The valve body 44 can be moved by a valve needle 46, displaceable horizontally in the drawing, which is coupled to the armature 18. When the electromagnet 14 is powered, the valve needle 46 moves to the left in FIG. 2, and the inlet valve 26 can be closed by the force of the valve spring 42.

If the electromagnet 14 is not powered, the inlet valve 26 can be forced open by the force of the armature spring 20. A piston 48, moveable vertically in the drawing, is arranged in the delivery chamber 36. The piston 48 can be moved by means of a roller 50 of a cam 52—elliptical in the present case—in a cylinder 54. The cylinder 54 is formed in a portion of the housing 12. The inlet valve 26 is hydraulically connected to the delivery chamber 36 via an opening 56.

In operation, the high-pressure fuel pump 10 delivers fuel from the inlet 24 to the outlet 30, wherein the outlet valve 32 opens or closes according to a respective pressure difference between the delivery chamber 36 and the outlet 30 or the high-pressure line 28. On full delivery, a respective pressure difference between the inlet 24 and the delivery chamber 36 acts on the inlet valve 26; on part delivery however, the valve needle 46 or the electromagnet 14 also act thereon.

Figure 2:
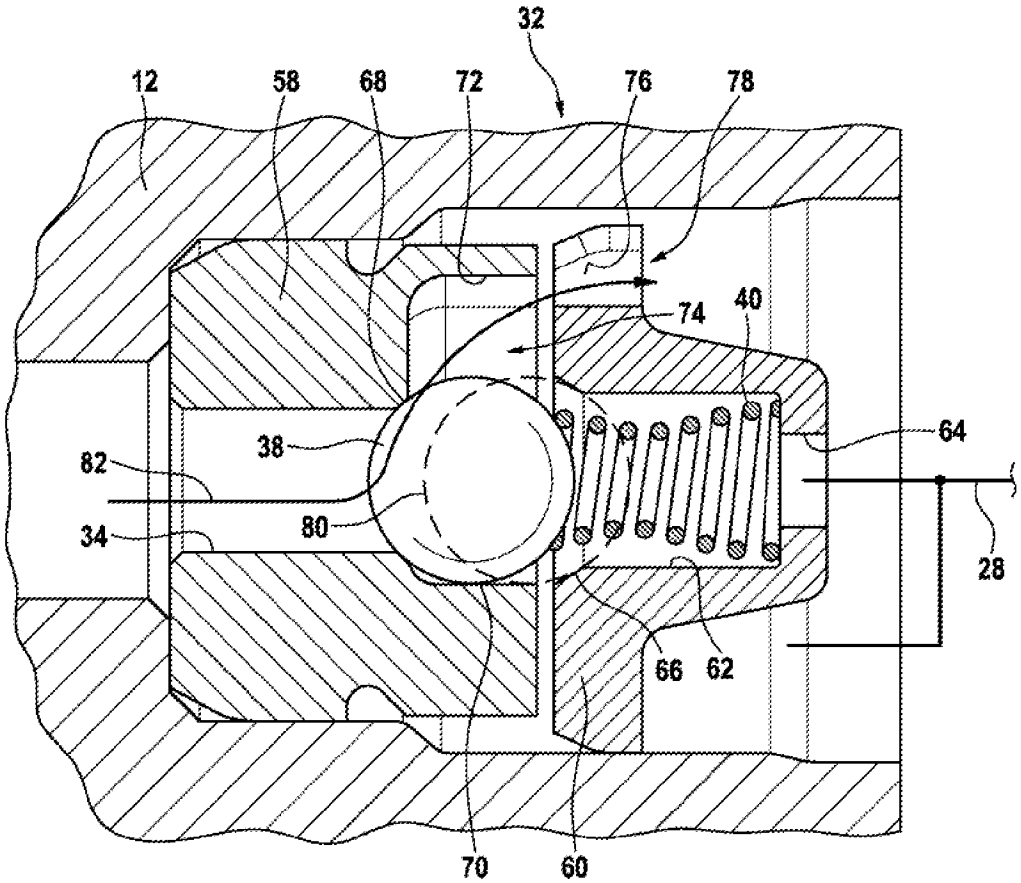
FIG. 2 an outlet valve of the high-pressure fuel pump of FIG. 1 in an axial section view.

FIG. 2 shows an axial section view of the outlet valve 32 which is arranged in the housing 12 of the high-pressure fuel pump 10. The outlet valve 32 is designed substantially rotationally symmetrical or radially symmetrical, and in the present case comprises four elements: a valve body 58 (on the left in the drawing), a stop body 60 (on the right in the drawing), the valve ball 38 arranged axially centrally between the valve body 58 and the stop body 60, and the valve spring 40 designed as a coil spring.

The valve spring 40 acts on the valve ball 38 in the closing direction and is received in a recess 62 of the stop body 60. The valve spring 40 here rests on a base (on the right in the drawing but without reference numeral) of the stop body 60. A radially inner limiting face of the recess 62 forms a guide for the valve spring 40. The recess 62 has a simple cylindrical cross-section. The base has an axially central opening 64 which has a smaller diameter than the valve spring 40. In the embodiment of the outlet valve 32 shown in FIG. 2, the valve spring 40 has (ever) varying diameters in the axial direction and is designed waisted in the present case.

An edge of the recess 62 facing the valve ball 38 in the stop body 60 forms an annular stop portion 66 for the valve ball 38. An annular, linear sealing seat 68 is formed on the valve body 58. On the right of the sealing seat 68 in the drawing, the valve body 58 has a guide collar 70 in which the valve ball 38 is guided radially. The guide collar 70 has a first plurality of recesses 72 which are arranged evenly distributed in the peripheral direction and form first flow channels 74. The guide collar 70 is designed radially symmetrically in an axial region of the first flow channels 74, corresponding to the first plurality of recesses 72.

Radially on its outside i.e. outside the recess 62, the stop body 60 has a second plurality of recesses 76 which are arranged evenly distributed in the peripheral direction and form second flow channels 78. In an axial region of the second flow channels 78, the stop body 60 is designed radially symmetrical, corresponding to the second plurality of recesses 76. In the present case, the first plurality and the second plurality are different and amount to three and five respectively, see FIG. 3 below.

In FIG. 2, the valve body 58 and the stop body 60 are arranged or shown axially spaced by a small dimension (without reference). In one embodiment (not shown) of the outlet valve 32, the valve body 58 and stop body 60 are arranged axially adjacent without spacing. Preferably, the stop body 60 and/or the valve body 58 are arranged by force fit in the housing 12, in that a radially outer face of the stop body 60 or valve body 58 is for example pressed against a radially inner wall portion of the housing 12. It is understood that to arrange the stop body 60 and/or valve body 58 in the housing 12, techniques other than pressing are possible according to the disclosure.

In the present case, the valve ball 38 is made of a steel material. The stop body 60 is produced by means of punching and deep-drawing. In total, the outlet valve 32 is dimensioned or configured such that in open state of the outlet valve 32, a resulting hydraulic cross-section area is sufficiently large to deliver a necessary fuel quantity with a comparatively low hydraulic flow resistance.

When, in operation of the high-pressure fuel pump 10, a fuel pressure in the delivery chamber 36 or in a region of the opening 34 is smaller than a fuel pressure in a region of the recess 62 plus the force of the valve spring 40, the valve ball 38 is pressed against the sealing seat 68, to the left in the drawing. The outlet valve 32 is thus closed.

When however the fuel pressure in the region of the opening 34 is greater than the fuel pressure in the region of the recess 62 plus the force of the valve spring 40, the valve ball 38 can lift away from the sealing seat 68, to the right in the drawing. The outlet valve 32 is thus opened.

Insofar as the fuel pressure in the region of the opening 34 is sufficiently large, the valve ball 38 can be pressed fully to the right in the drawing, up to the stop portion 66. This gives a "travel limitation" for the valve ball 38. A circle 80 shown in dotted lines indicates the position of the valve ball 38 in this extreme case. It is evident that the valve body 58 and the stop body 60 allow a radial guidance of the valve ball 38, see also FIG. 3 below.

An arrow 82 illustrates the resulting flow of fuel when the outlet valve 32 is opened. The flow takes place from left to right in the drawing, through the opening 34, then past the valve ball 38, then through the first flow channels 74 into the valve body 58, then through the second flow channels 78 into the stop body 60, then into the high-pressure line 28 and through to the high-pressure accumulator (not shown).

Figure 3:
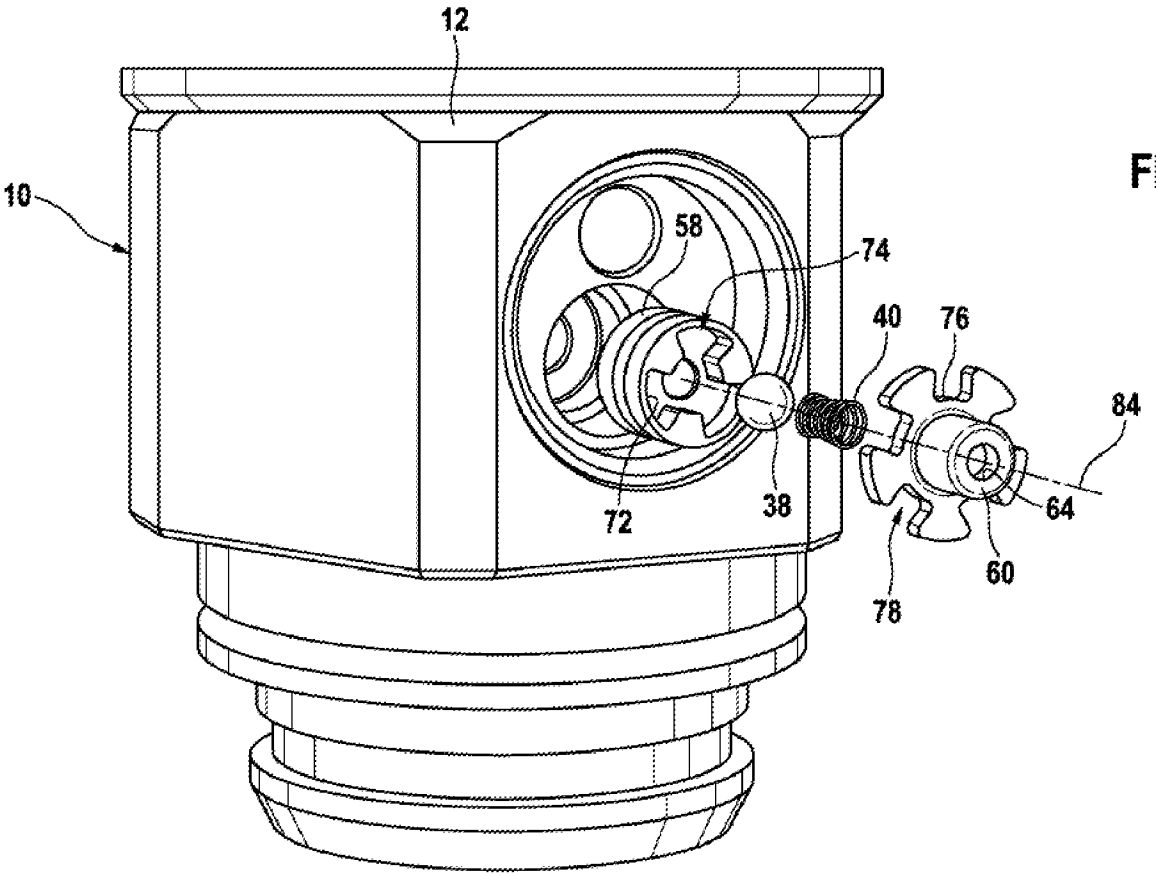
FIG. 3 a perspective view of elements of the outlet valve of FIG. 2 arranged spaced axially in the installation sequence (partly exploded depiction) in front of an opening on a housing of the high-pressure fuel pump.

FIG. 3 shows a perspective view of the high-pressure fuel pump 10 and housing 12 together with the elements of the outlet valve 32 described in FIG. 2. These elements are shown axially spaced, in the installation sequence, in a right-hand region in the drawing along a line 84, in front of an arrangement of openings (without reference) of the housing 12.

It is evident that the valve body 58 is designed radially symmetrical in a region of the guide collar 70, and in the present case comprises three first flow channels 74, wherein for reasons of clarity only one is marked with a reference numeral. The stop body 60 is also designed radially symmetrical in the region of the recesses 76, and in the present case comprises five second flow channels 78, wherein for reasons of clarity again only one carries a reference numeral.

Firstly, the cross-section areas of the second flow channels 78 are selected such that, independently of the radial orientation of the stop body 60 relative to the valve body 58, at least one of the second flow channels 78 at least partly overlaps one of the first flow channels 74. Secondly, because the first plurality and the second plurality are different, effectively a "radial interference" is created between the three first and the five second flow channels 74 and 78. This gives a resulting total hydraulic opening cross-section of the outlet valve 32 which is substantially independent of any arbitrary radial mounting angle between the guide collar 70 and the stop body 60.

The invention claimed is:

1. A high-pressure fuel pump, comprising:

an outlet valve with a valve ball;

a valve spring acting on the valve ball in the closing direction;

a valve body on which a sealing seat is formed and which has a guide collar in which the valve ball is guided radially;

a stop body configured for the valve ball, the stop body having a stop portion that limits the opening stroke of the valve ball, the valve spring rests on the stop body; and a recess formed in the stop body in which the valve spring is received at least in regions, the recess having a radial inner limiting face that forms a guide configured for the valve spring;

wherein the guide collar has a first plurality of recesses that are arranged evenly distributed in the peripheral direction and form first flow channels, and wherein the stop body, radially outside the recess, has a second plurality of recesses that are arranged evenly distributed in the peripheral direction and form second flow channels, the second flow channels having cross section areas that are selected such that, independently of the radial orientation of the stop body, at least one second flow channel at least partly overlaps with a first flow channel.

2. The high-pressure fuel pump as claimed in claim 1, wherein an edge of the recess facing the valve ball in the stop body forms an annular stop portion.

3. The high-pressure fuel pump as claimed in claim 1, wherein the valve ball comprises a steel material.

4. The high-pressure fuel pump as claimed in claim 1, wherein the recess has a simple cylindrical cross-section.

5. The high-pressure fuel pump as claimed in claim 1, wherein the valve spring is configured as a coil spring and has different diameters in the axial direction.

6. The high-pressure fuel pump as claimed in claim 1, wherein the number of recesses in the first plurality of recesses and the number of recesses in the second plurality of recesses are different.

7. The high-pressure fuel pump as claimed in claim 1, wherein the stop body is formed as one or more of a punched part and a deep-drawn part.

8. The high-pressure fuel pump as claimed in claim 1, wherein one or more of the stop body and the valve body are arranged by force fit in a housing of the outlet valve.

9. The high-pressure fuel pump as claimed in claim 1, wherein the coil spring is waisted.

* * * * *